US006090760A

United States Patent [19]

Cane et al.

[11] Patent Number: 6,090,760

[45] **Date of Patent: *Jul. 18, 2000**

[54] SULPHURIZED ALKALINE EARTH METAL HYDROCARBYL PHENATES, THEIR PRODUCTION AND USE THEREOF

[75] Inventors: Charles Cane, Hull; John Crawford, Caterham; Sean Patrick O'Connor, Beverley, all of United Kingdom

[73] Assignee: Lubrizol Adibis Holdings (UK) Ltd., United Kingdom

[ * ] Notice: This patent is subject to a terminal disclaimer.

[21] Appl. No.: 08/991,547

[22] Filed: Dec. 16, 1997

Related U.S. Application Data

[63] Continuation of application No. 08/339,650, Nov. 14, 1994, Pat. No. 5,714,443, which is a continuation of application No. 07/681,632, Apr. 2, 1991, abandoned, which is a continuation of application No. 07/216,636, Jun. 24, 1988, abandoned.

[30] Foreign Application Priority Data

Nov. 29, 1986 [GB] United Kingdom ..... 8628609
Nov. 26, 1987 [WO] WIPO ..... PCT/GB87/00848

[51] Int. Cl.[7] ..... C10M 159/22
[52] U.S. Cl. ..... 508/460; 508/574
[58] Field of Search ..... 508/574, 460

[56] References Cited

U.S. PATENT DOCUMENTS

| | | | |
|---|---|---|---|
| 2,695,910 | 11/1954 | Asseff et al. | 260/413 |
| 3,125,521 | 3/1964 | Detweiler et al. | 252/32.7 |
| 3,310,490 | 3/1967 | Nixon | 252/40.7 |
| 3,372,116 | 3/1968 | Meinhardt | 252/36 |
| 3,410,798 | 11/1968 | Cohen | 252/37.2 |
| 3,493,516 | 2/1970 | Allphin et al. | 252/33.3 |
| 3,544,463 | 12/1970 | Koft, Jr. | 252/40.7 |
| 3,714,042 | 1/1973 | Greenough | 252/33.2 |
| 3,773,664 | 11/1973 | Lesuer | 252/40.7 |
| 4,049,560 | 9/1977 | Dominey | 252/33.3 |
| 4,328,111 | 5/1982 | Watson et al. | 252/33.4 |
| 4,744,921 | 5/1988 | Liston | 252/42.7 |
| 5,069,804 | 12/1991 | Marsh et al. . | |
| 5,162,085 | 11/1992 | Cane et al. | 252/18 |
| 5,223,163 | 6/1993 | Coolbaugh | 252/33.3 |
| 5,281,345 | 1/1994 | Crawford et al. | 252/18 |
| 5,320,763 | 6/1994 | Campbell | 252/25 |
| 5,330,665 | 7/1994 | Cane et al. | 252/25 |
| 5,397,484 | 3/1995 | Cane et al. | 252/18 |
| 5,433,871 | 7/1995 | O'Connor et al. | 252/18 |
| 5,437,803 | 8/1995 | Cane et al. | 508/460 |
| 5,441,652 | 8/1995 | O'Connor et al. | 508/460 |
| 5,602,084 | 2/1997 | Moreton | 508/460 |
| 5,674,821 | 10/1997 | Cook et al. | 508/574 |
| 5,714,443 | 2/1998 | Cane et al. | 508/460 |
| 5,716,914 | 2/1998 | Cane et al. | 508/460 |

FOREIGN PATENT DOCUMENTS

| | | |
|---|---|---|
| 0094814 | 11/1983 | European Pat. Off. . |
| 0095322 | 11/1983 | European Pat. Off. . |
| 43-14206 | 6/1968 | Japan . |
| 1105217 | 3/1968 | United Kingdom . |
| 1225039 | 3/1971 | United Kingdom . |
| 1440261 | 6/1976 | United Kingdom . |
| 1452513 | 10/1976 | United Kingdom . |
| 1469289 | 4/1977 | United Kingdom . |
| 1470338 | 4/1977 | United Kingdom . |
| 2 142928A | 1/1985 | United Kingdom . |

OTHER PUBLICATIONS

T. Hori et al., Bulletin of The Japan Petroleum Institute, vol. 16, No. 1, May 1974, "Study on Over–Based Sulfurized Calcium Phenate Homologs (Part 1)".

*Primary Examiner*—Jerry D. Johnson
*Attorney, Agent, or Firm*—Michael Esposito, Esq.

[57] ABSTRACT

An additive concentrate suitable for incorporation into a finished lubricating oil composition is disclosed. The additive concentrate comprises: (a) a lubricating oil; (b) a lubricating oil soluble sulphurized alkaline earth metal hydrocarbyl phenate modified by incorporation of from greater than 2 to 35% by weight based on the weight of the composition of either (i) at least one carboxylic acid having formula (I),

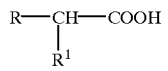

(I)

wherein R is $C_{10}$ to $C_{24}$ alkyl or alkenyl group and $R^1$ is either hydrogen, a $C_1$ to $C_4$ alkyl group or a —$CH_2$—COOH group, or an anhydride, acid chloride or ester thereof or (ii) a di- or polycarboxylic acid containing from 36 to 100 carbon atoms or an anhydride, acid chloride or ester thereof, the composition having a TBN greater than 300. A process for making the foregoing additive concentrate is disclosed. A finished lubricating oil composition containing the foregoing additive concentrate is also disclosed.

29 Claims, No Drawings

SULPHURIZED ALKALINE EARTH METAL HYDROCARBYL PHENATES, THEIR PRODUCTION AND USE THEREOF

This is a continuation of application Ser. No. 08/339,650, filed Nov. 14, 1994, now U.S. Pat. No. 2,714,443 which is a continuation of Ser. No. 07/681,632, filed Apr. 2, 1991, abandoned, which is a continuation of Ser. No. 07/216,636, filed Jun. 24, 1988, abandoned.

The present invention relates in general to sulphurised alkaline earth metal hydrocarbyl phenates, their production and use thereof as lubricating oil additives. In particular the present invention relates to sulphurised alkaline earth metal hydrocarbyl phenate-containing compositions having a high total base number (TBN) and an acceptable viscosity and to their production from sulphurised alkaline earth metal hydrocarbyl phenates having lower TBNs.

In the internal combustion engine, by-products from the combustion chamber often blow by the piston and admix with the lubricating oil. Many of these by-products form acidic materials within the lubricating oil. This is particularly marked in diesel engines operating on low-grade fuels of high sulphur content wherein corrosive acids are produced by combustion. The acids thereby incorporated in the lubricating oil can include sulphur acids produced by oxidation of sulphur, hydrohalic acids derived from halogen lead scavengers in the fuel and nitrogen acids produced by the oxidation of atmospheric nitrogen within the combustion chamber. Such acids cause deposition of sludge and corrosion of the bearings and engine parts leading to rapid wear and early breakdown of the engine.

One class of compounds generally employed to neutralise the acidic materials and disperse sludge within the lubricating oil are the sulphurised metal alkyl phenates, wherein the metal is an alkaline earth metal such as calcium, magnesium or barium. Both "normal" and "overbased" sulphurised alkaline earth metal alkyl phenates have been employed. The term "overbased" is used to describe those sulphurised alkaline earth metal alkyl phenates in which the ratio of the number of equivalents of the alkaline earth metal moiety to the number of equivalents of the phenol moiety is greater than one, and is usually greater than 1.2 and may be as high as 4.5 or greater. In contrast, the equivalent ratio of alkaline earth metal moiety to phenol moiety in "normal" alkaline earth metal alkyl phenates is one. Thus, the "overbased" material contains greater than 20% in excess of the alkaline earth metal present in the corresponding "normal" material. For this reason "overbased" sulphurised alkaline earth metal alkyl phenates have a greater capability for neutralising acidic matter than do the corresponding "normal" alkaline earth metal alkyl phenates.

The prior art teaches many methods for preparing both "normal" and "overbased" sulphurised metal alkyl phenates. One such method for preparing "overbased" sulphurised alkyl phenates generally referred to as the "single lime addition" process comprises reacting an alkyl phenol, in the presence of lubricating oil, sulphur, a hydroxylic compound and excess alkaline earth metal hydroxide (above the stoichiometric proportion required to neutralise the alkyl phenol), to form an intermediate product, followed by carbonation, a heading distillation (to remove unreacted hydroxylic compound) and filtration. The production of intermediate product is accompanied by a marked increase in viscosity while the subsequent carbonation reduces the viscosity to a relatively low level. The increase in viscosity accompanying the formation of the intermediate product is undesirable because the reaction mixture becomes difficult to agitate to the detriment of subsequent reactions. Whilst this increase in viscosity may be controlled to an acceptable level by incorporation of less alkaline earth metal hydroxide in the reaction, the overbased alkyl phenate product necessarily possesses a reduced neutralisation capacity. In order to achieve a high neutralisation capacity product and at the same time control the viscosity of the intermediate product within acceptable limits, the alkaline earth metal hydroxide may be added in two, (generally referred to as the "double lime additions" process) or three separate reaction steps, with sequential carbonation steps. However, this method involves relatively long batch times. Another alternative is to use viscosity depressants, such as tridecanol, 2-ethylhexanol, or similar boiling range hydroxylic solvent, in the production of the intermediate product but such an expedient increases the raw material cost of the process. The highest total base number (TBN), as measured in mg KOH/g, consistent with an acceptable viscosity, generally achievable by prior art processes is about 300, though generally prior art TBNs are in the range from 200–300. It would clearly be a desirable objective to produce sulphurised alkaline earth metal alkyl phenate compositions having a high TBN that is a TBN greater than 300, and preferably greater than 350. It would also be a desirable objective to produce such materials from sulphurised alkaline earth metal alkyl phenates having a lower TBN. To date it has not been found possible to achieve products of such high TBN because the use of larger concentrations of alkaline earth metal base leads to highly viscous products which, rather than being 'thinned' by subsequent carbonation attempts using excess carbon dioxide, are rendered insoluble. We have achieved these objectives and thereby achieved compositions having a TBN in excess of 300 and in some cases greater than 350 whilst retaining an acceptable viscosity, that is a viscosity of less than 1000 cSt, and avoiding insolubility by incorporating into a reaction mixture containing a sulphurised alkaline earth metal alkyl phenate at least one carboxylic acid or acid derivative thereof having at least 10 carbon atoms in the molecule.

The use of carboxylic acids in the production of sulphurised alkaline earth metal alkyl phenates is not new, see for example U.S. Pat. No. 4,049,560 and EP-A-0094814.

U.S. Pat. No. 4,049,560 describes the production of an overbased magnesium detergent by a process in which carbon dioxide is introduced into a reaction mixture which comprises:

(a) 15–40 wt % of a sulphurised phenol or thiophenol containing one or more hydrocarbyl substituents, or a phenol or thiophenol containing one or more hydrocarbyl substituents, or said phenol or thiophenol containing one or more hydrocarbyl substituents together with sulphur, (b) 5–15 wt % of an organic sulphonic acid, an organic sulphonate or an organic sulphate, (c) 5–15 wt % of a glycol, a $C_1$ to $C_5$ monohydric alkanol or $C_2$ to $C_4$ alkoxy alkanol, (d) 2–15 wt % of a magnesium hydroxide or active magnesium oxide, (e) at least 0.1 wt % of a $C_1$ to $C_{18}$ carboxylic acid, an anhydride thereof, or an ammonium, an amine salt, a Group I metal or a Group II metal salt of said $C_1$ to $C_{18}$ carboxylic acid, and (f) at least 10% by weight of a diluent oil (including any present in components (a) and (b).

The amount of carboxylic acid (component (e)) is preferably in the range 0.5 to 2.0% by weight. The product prepared by this reaction is said to have a TBN of about 200 to 250, e.g. about 225.

EP-A-0094814 discloses an additive concentrate for incorporation in a lubricating oil composition comprising lubricating oil, and from 10 to 90 wt % of an overbased alkaline earth metal hydrocarbyl sulphurised phenate which has been treated, either during or subsequent to the overbasing process, with from 0.1 to 10, preferably 2 to 6, wt % (based on the weight of additive concentrate) of an acid of the formula:

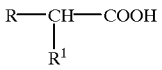

(I)

(wherein R is a $C_{10}$ to $C_{24}$ unbranched alkyl or alkenyl group, and $R^1$ is hydrogen, a $C_1$ to $C_4$ alkyl group or a —$CH_2$—COOH group) or an anhydride or a salt thereof. The object of the invention of EP-A-0094814 is to overcome problems encountered with many additive concentrates containing overbased additives, namely lack of stability giving rise to sedimentation and foaming problems. The problem of EP-A-0094814 is not that of producing phenates having a TBN of greater than 300 and indeed the phenates produced by the process of the invention, although overcoming the problems of stability and foaming, have TBN values of less than 300.

It can be concluded that the prior art in which carboxylic acids are employed does not address the problem of producing overbased sulphurised alkaline earth metal alkyl phenates having a TBN of greater than 300 and an acceptable viscosity.

Accordingly, in one aspect the present invention provides an additive concentrate suitable for incorporation into a finished lubricating oil composition, the additive concentrate comprising:

(a) a lubricating oil, (b) a lubricating oil soluble sulphurised alkaline earth metal hydrocarbyl phenate modified by incorporation of from greater than 2 to 35% by weight based on the weight of the composition of either (i) at least one carboxylic acid having the formula:

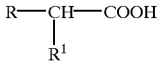

(I)

wherein R is a $C_{10}$ to $C_{24}$ alkyl or alkenyl group and $R^1$ is either hydrogen, a $C_1$ to $C_4$ alkyl group or a —$CH_2$—COOH group, or an anhydride, acid chloride or ester thereof or (ii) a di- or polycarboxylic acid containing from 36 to 100 carbon atoms or an anhydride, acid chloride or ester thereof, the composition having a TBN greater than 300.

Component (a) of the composition is a lubricating oil. The lubricating oil may suitably be either an animal oil, a vegetable oil or a mineral oil. Suitably the lubricating oil may be a petroleum-derived lubricating oil, such as a naphthenic base, paraffin base or mixed base oil. Solvent neutral oils are particularly suitable. Alternatively, the lubricating oil may be a synthetic lubricating oil. Suitable synthetic lubricating oils include synthetic ester lubricating oils, which oils include diesters such as di-octyl adipate, di-octyl sebacate and tridecyladipate, or polymeric hydrocarbon lubricating oils, for example liquid polyisobutenes and polyalpha olefins. The lubricating oil may suitably comprise from 10 to 90%, preferably from 10 to 70%, by weight of the composition.

Component (b) is a lubricating oil soluble sulphurised alkaline earth metal hydrocarbyl phenate modified by incorporation of from greater than 2 to 35% by weight based on the weight of the composition of either (i) or (ii). Suitably the alkaline earth metal may be strontium, calcium, magnesium or barium, preferably calcium, barium or magnesium, more preferably calcium.

The hydrocarbyl phenate moiety of the sulphurised alkaline earth metal hydrocarbyl phenate is preferably derived from at least one alkyl phenol. The alkyl groups of the alkyl phenol may be branched or unbranched. Suitable alkyl groups contain from 4 to 30, preferably from 9 to 28 carbon atoms. A particularly suitable alkyl phenol is the $C_{12}$-alkyl phenol obtained by alkylating phenol with propylene tetramer.

The sulphurised alkaline earth metal hydrocarbyl phenate is modified by incorporation of either (i) or (ii). As regards (i), this is at least one carboxylic acid having the formula (I) or an acid anhydride, acid chloride or ester thereof. Preferably R in the formula (I) is an unbranched alkyl or alkenyl group. Preferred acids of formula (I) are those wherein R is a $C_{10}$ to $C_{24}$, more preferably $C_{18}$ to $C_{24}$ straight chain alkyl groups and $R^1$ is hydrogen. Examples of suitable saturated carboxylic acids of formula (I) include capric acid, lauric acid, myristic acid, palmitic acid, stearic acid, arachidic acid, behenic acid and lignoceric acid. Examples of suitable unsaturated acids of formula (I) include lauroleic acid, myristoleic acid, palmitoleic acid, oleic acid, gadoleic acid, erucic acid, ricinoleic acid, linoleic acid and linolenic acid. Mixtures of acids may also be employed, for example rape top fatty acids. Particularly suitable mixtures of acids are those commercial grades containing a range of acids, including both saturated and unsaturated acids. Such mixtures may be obtained synthetically or may be derived from natural products, for example cotton oil, ground nut oil, coconut oil, linseed oil, palm kernel oil, olive oil, corn oil, palm oil, castor oil, soyabean oil, sunflower oil, herring oil, sardine oil and tallow. Sulphurised acids and acid mixtures may also be employed. Instead of, or in addition to, the carboxylic acid there may be used the acid anhydride, the acid chloride or the ester derivatives of the acid, preferably the acid anhydride. It is preferred however to use a carboxylic acid or a mixture of carboxylic acids. A preferred carboxylic acid of formula (I) is stearic acid.

Instead of, or in addition to (i), the sulphurised alkaline earth metal hydrocarbyl phenate may be modified by incorporation of (ii), which is a di- or polycarboxylic acid containing from 36 to 100 carbon atoms or an acid anhydride, acid chloride or ester derivative thereof, preferably an acid anhydride thereof. Preferably (ii) is a polyisobutene succinic acid or a polyisobutene succinic anhydride.

Preferably the carboxylic acid(s) having the formula (I), the di- or polycarboxylic acid, or the acid anhydride, acid chloride or ester thereof is incorporated in an amount from greater than 10% to 35%, more preferably from 12 to 20%, for example about 16% by weight based on the weight of the composition. An advantage of incorporating greater than 10% of the carboxylic acid or derivative thereof is generally a relativelylower concentrate viscosity.

Suitably the alkaline earth metal may be present in the composition in an amount in the range from 10 to 20% by weight based on the weight of the composition.

Suitably sulphur may be present in the composition in an amount in the range from 1 to 6, preferably from 1.5 to 3% by weight based on the weight of the composition.

Suitably carbon dioxide may be present in the composition in an amount in the range from 5 to 20, preferably from 9 to 15% by weight based on the weight of the composition.

Preferably the TBN of the composition is greater than 350, more preferably greater than 400.

Suitably the composition may have a viscosity measured at 100° C. of less than 1000 cSt, preferably less than 750 cSt, more preferably less than 500 cSt.

In another aspect the present invention provides an additive concentrate suitable for incorporation into a finished lubricating oil which concentrate is obtainable by reacting at elevated temperature (A) a sulphurised alkaline earth metal hydrocarbyl phenate having a TBN less than that of the final additive concentrate, (B) an alkaline earth metal base added in either a single addition or in a plurality of additions at intermediate points during the reaction, (C) either a polyhydric alcohol having from 2 to 4 carbon atoms, a di- or tri- ($C_2$ to $C_4$) glycol, an alkylene glycol alkyl ether or a polyalkylene glycol alkyl ether, (D) a lubricating oil, (E) carbon dioxide added subsequent to the, or each, addition of component (B), and (F) sufficient to provide from greater than 2 to 35% by weight based on the weight of the concentrate of either (i) a carboxylic acid having the formula (I) or an acid anhydride, acid chloride or ester thereof or (ii) a di- or polycarboxylic acid containing from 36 to 100 carbon atoms or an acid anhydride, acid chloride or ester thereof, the weight ratio of components (A) to (F) being such as to produce a concentrate having a TBN greater than 300.

In yet another aspect the present invention provides a process for the production of an additive concentrate for incorporation into a finished lubricating oil which process comprises reacting at elevated temperature components (A) to (F) as hereinbefore described, the weight ratios of components (A) to (F) being such as to produce a concentrate having a TBN greater than 300.

The process of the invention is advantageous because it affords a method for up-grading low TBN products of the prior art or off-specification products into high TBN products having an acceptable viscosity. Moreover, because hydrogen sulphide is not evolved during operation of the process of the invention, in contrast to processes for producing sulphurised alkaline earth metal alkyl phenates involving the reaction of an alkyl phenol and sulphur, by the more conventional routes, the hydrogen sulphide disposal problem is avoided, thereby allowing manufacture in environmentally sensitive locations and the use of less sophisticated plant.

Component (A) of the reaction mixture is a sulphurised alkaline earth metal hydrocarbyl phenate having a TBN lower than that of the final product, i.e. generally less than 300. Any sulphurised alkaline earth metal hydrocarbyl phenate may be employed. The sulphurised alkaline earth metal hydrocarbyl phenate may be carbonated or non-carbonated. The alkaline earth metal moiety and the hydrocarbyl phenate moiety of the sulphurised alkaline earth metal hydrocarbyl phenate may suitably be as hereinbefore described. Methods for preparing sulphurised alkaline earth metal hydrocarbyl phenates are well known in the art. Alternatively, the precursors of a sulphurised alkaline earth metal hydrocarbyl phenate in the form of a non-sulphurised alkaline earth metal hydrocarbyl phenate and sulphur may be employed.

The alkaline earth metal base (component B) may suitably be an alkaline earth metal oxide or hydroxide, preferably the hydroxide. Calcium hydroxide may be added or example in the form of slaked lime. Preferred alkaline earth metals are calcium, magnesium and barium and more preferred is calcium. The alkaline earth metal base must be added in an amount relative to component (A) sufficient to produce a product having a TBN in excess of 300, preferably in excess of 350. This amount will depend on a number of factors including the nature of the sulphurised alkaline earth metal hydrocarbyl phenate. Typically, the weight ratio of component (B) to component (A) may suitably be in the range from 0.1 to 50, preferably from 0.2 to 5. The alkaline earth metal base (B) may be added in whole to the initial reactants, or in part to the initial reactants and the remainder in one or more portions at a subsequent stage or stages in the process. Preferably component (B) is added in a single addition to the initial reactants.

Component (C) is either a polyhydric alcohol having from 2 to 4 carbon atoms, a di- or tri- ($C_2$ to $C_4$) glycol, an alkylene glycol alkyl ether or a polyalkylene glycol alkyl ether. The polyhydric alcohol may suitably be either a dihydric alcohol, for example ethylene glycol or propylene glycol, or a trihydric alcohol, for example glycerol. The di- or tri- ($C_2$ to $C_4$) glycol may suitably be either diethylene glycol or triethylene glycol. The alkylene glycol alkyl ether or polyalkylene glycol alkyl ether may suitably be of the formula:

$$R(OR^1)_xOR^2 \quad \text{(II)}$$

wherein R is a $C_1$ to $C_6$ alkyl group, $R^1$ is an alkylene group, $R^2$ is hydrogen or $C_1$ to $C_6$ alkyl and x is an integer in the range from 1 to 6. Suitable solvents having the formula (II) include the monomethyl or dimethyl ethers of ethylene glycol, diethylene glycol, triethylene glycol or tetraethylene glycol. A particularly suitable solvent is methyl digol ($CH_3OCH_2CH_2OCH_2CH_2OH$). Mixtures of glycols and glycol ethers of formula (II) may also be employed. Using a glycol or glycol ether of formula (II) as solvent it is preferred to use in combination therewith an inorganic halide, for example ammonium chloride, and a lower, i.e. $C_1$ to $C_4$, carboxylic acid, for example acetic acid. Preferably the component (C) is either ethylene glycol or methyl digol, the latter in combination with ammonium chloride and acetic acid.

Component (D) is a lubricating oil as hereinbefore described with reference to the concentrate composition.

Component (E) is carbon dioxide, which may be added in the form of a gas or a solid, preferably in the form of a gas. In gaseous form it may suitably be blown through the reaction mixture. We have found that generally the amount of carbon dioxide incorporated increases with increasing concentrations of component (F). The carbon dioxide is preferably added subsequent to a single addition of component (B) at the conclusion of the reaction between component (A), (B), (C), (D) and (F).

Component (F) is either a carboxylic acid of formula (I), a di- or polycarboxylic acid containing from 36 to 100 carbon atoms, or an acid anhydride, an acid chloride or ester thereof as hereinbefore described with reference to the concentrate composition. The amount of the aforesaid required to provide from greater than 2 to 35% by weight based on the weight of the concentrate will be to a first approximation the amount derived in the concentrate. In calculating this amount allowance should be made for loss of water from carboxylic acids, for example.

The reaction may be performed in the presence of a diluent. Suitable diluents are liquids having a volatility consistent with operation of the process, i.e. having a volatility such that they are readily strippable from the reaction mixture at the conclusion of the reaction. Examples of suitable diluents include 2-ethyl hexanol, iso-octanol, iso-heptanol and tri-decanol.

Further sulphur, that is sulphur additional to that already present by way of component (A), may be added to the reaction mixture. An advantage of adding further sulphur is that it increases the amount of sulphur in the concentrate, which may be desirable for certain applications. On the other hand sulphur addition leads to the evolution of hydrogen sulphide, thereby to some extent detracting from the advantage of the invention as hereinbefore mentioned.

Preferably the reaction is carried out in the presence of a further component which is a catalyst for the reaction. As catalyst there may be used an inorganic halide which may suitably be either a hydrogen halide, an ammonium halide or a metal halide. Suitably the metal moiety of the metal halide may be zinc, aluminium or an alkaline earth metal, preferably calcium. Of the halides, the chloride is preferred. Suitable catalysts include hydrogen chloride, calcium chloride, ammonium chloride, aluminium chloride and zinc chloride, preferably calcium chloride. Suitably the amount of catalyst employed may be up to 2.0% wt/wt.

Suitably the reaction of components (A)–(F) and also the carbonation reaction may be carried out at elevated temperatures in the range from 120 to 200, preferably from about 130 to 165° C., though the actual temperatures chosen for the reaction of components (A)–(F) and the carbonation may differ if desired. The pressure may be atmospheric, subatmospheric or superatmospheric.

The concentrate may be recovered by conventional means, for example by distillative stripping of component (C) and diluent (if any).

Finally, it is preferred to filter the concentrate so-obtained. Generally, the process of the invention will produce a concentrate having an acceptable viscosity, that is a viscosity of less than 1000 cSt at 100° C., and can produce concentrates having a viscosity less than 750 or 500 cSt at 100° C. Moreover, the concentrates generally have desirable viscosity index properties. Such viscometric properties are advantageous because they facilitate processing (including filtration) of the concentrate. However, it is also possible to produce concentrates having a higher viscosity than 1000 cSt at 100° C., generally at higher TBN levels. Filtration of such concentrates presents a problem, which may be overcome by adding a diluent prior to filtration and stripping the diluent off after filtration. Alternatively, or in addition, the concentrate may be diluted with lubricating oil and still retain a TBN in excess of 300, particularly if the TBN of the concentrate as produced is high, for example above 400.

In a final aspect the present invention provides a finished lubricating oil composition which composition comprises a lubricating oil and sufficient of the additive concentrate as hereinbefore described to provide a TBN in the range from 0.5 to 120.

Preferably the finished lubricating oil composition contains sufficient of the concentrate composition to provide a TBN in the range from 0.5 to 100.

The amount of concentrate composition present in the finished lubricating oil will depend on the nature of the final use. Thus, for marine lubricating oils the amount of concentrate composition present may suitably be sufficient to provide a TBN in the range from 9 to 100 and for automobile engine lubricating oils the amount may suitably be sufficient to provide a TBN in the range from 4 to 20.

The finished lubricating oil may also contain effective amounts of one or more other types of conventional lubricating oil additives, for example viscosity index improvers, anti-wear agents, antioxidants, dispersants, rust inhibitors, pour-point depressants, or the like, which may be incorporated into the finished lubricating oil composition either directly or through the intermediacy of the concentrate composition.

In addition to their use as additives for incorporation into lubricating oil compositions, the concentrate compositions of the present invention may also find application as fuels additives.

The invention will now be further illustrated by reference to the following Examples.

In all the Examples the term "TBN" is used. The TBN is the Total Base Number in mg KOH/g as measured by the method of ASTM D2896.

In all the Examples, except otherwise expressly stated, a commercially available sulphurised calcium alkyl phenate derived from a $C_{12}$-alkyl phenol was employed. The phenate is supplied as a solution in lubricating oil, which forms from 36–40% w/w of the composition. The composition has a TBN of 250 and a composition as follows:—calcium (9.25% w/w), sulphur (3.25% w/w) and carbon dioxide (4.6% w/w). Where the "Charge" for any Example includes lubricating oil, this is additional to that already present in the phenate composition.

The viscosity was measured by the method of ASTM D445.

EXAMPLE 1

Up-grading of Sulphurised Calcium Alkyl Phenate

| | | |
|---|---|---|
| Charge: | Lubricating oil | (57 g) |
| | Sulphurised calcium alkyl phenate | (206 g) |
| | Lime | (49 g) |
| | Stearic acid | (70 g) |
| | Calcium chloride | (4 g) |
| | 2-ethyl hexanol | (112 g) |

The charge was heated to 145–165° C./700 mm Hg whilst adding 36 g ethylene glycol. It was then maintained for one hour at 165° C./700 mg Hg. Carbon dioxide (50 g) was added at 165° C. over 1 hour. The product was cooled to 125° C./700 mm Hg. Lime (33 g) was added. The temperature was raised to 165° C./700 mm Hg and held at this temperature for one hour. Carbon dioxide (25 g) was added at 165° C. over one hour. The product was then stripped at 200° C./10 mm Hg. Finally the product was filtered. It was observed that the filtration rate was very fast. 437 g product and 167 g distillate were obtained.

The product was analysed for calcium, sulphur and carbon dioxide. Its TBN, BPHVI50 and Viscosity at 100° C. were determined. The BPHV150 determination is a solubility test. Results of the test are expressed on the scale 1 (highly soluble; pass), 2 (borderline) and 3 (fail).

Results

| | |
|---|---|
| Calcium | = 13.9% w/w (corresponding to 96% retention in the product of the calcium charged. |
| Sulphur | = 1.5% w/w (corresponding to 100% retention in the product of the sulphur charged). |
| Carbon Dioxide | = 12.3% w/w (corresponding to 62% retention in the product of the $CO_2$ charged). |
| TBN | = 395 |
| $V_{100}$ | = 228 cSt |
| BPHVI5O | = 1A |
| Stearic acid | = 16% w/w |

This Example demonstrates that a low TBN product can be converted to a high TBN product having an acceptable viscosity by the process of the invention.

EXAMPLE 2

| | | |
|---|---|---|
| Charge: | Sulphurised Calcium alkyl phenate | 230 g |
| | Lubricating oil | 26 g |
| | Calcium chloride | 3 g |

Method (a) The charge was heated to 100° C./700 mm Hg. Stearic acid (63 g) was added and the mixture stirred for 15 minutes,
(b) 2-Ethyl hexanol (190 g) was added at 100–110° C./700 mm Hg,
(c) Lime (66 g) was added at 110° C./700 mm Hg,
(d) The mixture was heated to 165° C./700 mm Hg and ethylene glycol (32 g) was added quickly (one minute),
(e) The mixture was held for 5 minutes at 165° C./700 mm Hg,
(f) Carbon dioxide (66 g) was then added at 165° C./1 bar,
(g) The solvent was recovered at 200° C./10 mm Hg, and
(h) The stripped product was filtered.

Product Weights

| | |
|---|---|
| Crude Product | 398 g |
| Distillate | 236 g |

Product Composition After Filtration

The filtration rate was fast.

| | |
|---|---|
| Calcium | 14.1 % w/w |
| Sulphur | 2.0 % w/w |
| $CO_2$ | 12.9 % w/w |
| TBN | 399 |
| $V_{100}$ | 825 cSt |
| Stearic acid | 15.8 % w/w |

EXAMPLE 3

Charge: As for Example 2.

Method

As for Example 2 except that the temperature was 145° C. instead of 165° C. in steps (d), (e) and (f).

Product Weights

| | |
|---|---|
| Crude Product | 402 g |
| Distillate | 239 g |

Product Composition After Filtration

| | |
|---|---|
| Calcium | 13.9 % w/w |
| Sulphur | 1.9 % w/w |
| $CO_2$ | 13.9 % w/w |
| TBN | 392 |
| $V_{100}$ | 206 cSt |
| Stearic acid | 15.7 % w/w |

EXAMPLE 4

Charge: As for Example 2

Method

As for Example 2 except that the temperature was 130° C. instead of 165° C. in steps (d), (e) and (f).

Products Weights

| | |
|---|---|
| Crude Product | 377 g |
| Distillate | 236 g |

Product Composition After Filtration

| | |
|---|---|
| Calcium | 13.7 % w/w |
| Sulphur | 2.1 % w/w |
| $CO_2$ | 13.2 % w/w |
| TBN | 380 |
| $V_{100}$ | 99 cSt |
| Stearic acid | 16.7 % w/w |

EXAMPLE 5

Charge: As for Example 3 except that calcium chloride was omitted.
Method As for Example 3.

Product Weights

| | |
|---|---|
| Crude Product | 388 g |
| Distillate | 239 g |

Product Composition After Filtration

| | |
|---|---|
| Calcium | 11.9 % w/w |
| Sulphur | 2.1 % w/w |
| $CO_2$ | 9.0 % w/w |
| TBN | 331 |
| $V_{100}$ | 98 cSt |
| $V_{40}$ | 1490 cSt |
| VI | 148 |
| Stearic acid | 16.2 % w/w |

The filtration step (h) was very difficult.

This Example, as compared with Example 3 demonstrates the desirability of using a catalyst in the process of the invention. In the absence of catalyst, although a lower $V_{100}$ was obtained, this was achieved at the expense of reduced incorporation of calcium and carbon dioxide, and moreover filtration was difficult.

EXAMPLE 6

| | | |
|---|---|---|
| Charge: | Sulphurised calcium alkyl phenate | 253 g |
| | Lubricating oil (100 SN) | 26 g |
| | Calcium chloride | 4 g |
| | 2-Ethyl hexanol | 190 g |
| | Stearic acid | 40 g |

Method (a) The charge was heated to 120° C./700 mm Hg and lime (36 g) was then added,
(b) The mixture was heated to 145–165° C. whilst adding ethylene glycol (32 g),
(c) The mixture was held for one hour at 165° C./700 mm Hg,
(d) Carbon dioxide (44 g) was added at 165° C./1 bar,
(e) The mixture was cooled to 120° C. and lime (25 g) was added,
(f) The mixture was held at 165° C./700 mm Hg for one hour,
(g) Carbon dioxide (22 g) was added at 165° C./1 bar,
(h) The solvent was stripped off at 200° C./10 mm Hg, and
(i) The product was filtered. The filtration rate was fast.

Product Weights

| | |
|---|---|
| Crude Product | 401 g |
| Distillate | 239 g |

Product Composition After Filtration

| | |
|---|---|
| Calcium | 14.3 % w/w |
| Sulphur | 2.1 % w/w |
| $CO_2$ | 11.3 % w/w |
| TBN | 405 |
| $V_{100}$ | 1483 cSt |
| Stearic acid | 10 % w/w |

This Example demonstrates that it is possible to produce a high TBN concentrate, though the viscosity is relatively high, by incorporating 10% w/w stearic acid.

EXAMPLE 7

| | |
|---|---|
| Charge: | As for Example 6 except that the phenate was increased from 250 g to 268 g and the stearic acid was increased from 40 g to 51 g. |
| Method: | As for Example 6. |

Products Weights

| | |
|---|---|
| Crude Product | 396 g |
| Distillate | 234 g |

Product Composition After Filtration

| | |
|---|---|
| Calcium | 14.5 % w/w |
| Sulphur | 2.2 % w/w |
| $CO_2$ | 13.1 % w/w |
| TBN | 399 |
| $V_{100}$ | 706 cSt |
| Stearic acid | 12.9 % w/w |

This Example demonstrates that a high TBN concentrate having a lower viscosity as compared with Example 6 can be produced at a stearic acid content of 12.9% w/w based on the weight of the concentrate.

EXAMPLE 8

| | | |
|---|---|---|
| Charge: | Sulphurised calcium alkyl phenate | 230 g |
| | Lubricating oil (SN 100) | 0 g |
| | Calcium chloride | 3 g |

Method (a) The charge was heated to 100° C., stearic acid (99 g) was then added and the mixture was stirred for 15 minutes,
(b) 2-Ethyl hexanol (190 g) was added at 100–110° C.,
(c) Lime (66 g) was added at 110° C./2" Hg vacuum,
(d) The mixture was heated to 145° C./10" Hg and ethylene glycol (32 g) was added over 20 minutes,
(e) The mixture was held for 5 minutes at 145° C./10" Hg,
(f) Carbon dioxide (66 g) was added at 145° C.,
(g) The product was stripped at 200° C./30" Hg, and
(h) The product was filtered. The filtration rate was slow.

Product Weights

| | |
|---|---|
| Crude Product | 398 g |
| Distillate | 209 g |

Product Composition After Filtration

| | |
|---|---|
| Calcium | 11.95 % w/w |
| Sulphur | 1.65 % w/w |
| $CO_2$ | 11.6 % w/w |
| TBN | 349 |
| $V_{100}$ | 100 cSt |
| $V_{40}$ | 974 cSt |
| Stearic acid | 24.9 % w/w |

This Example demonstrates that it is possible to produce a high TBN concentrate having a low viscosity at a stearic acid content of 24.9% w/w.

Comparison Test 1

| | |
|---|---|
| Charge: | As for Example 3. |

Method

As for Example 3 except that the addition of ethylene glycol in step (d) was omitted.

Product Weights

| | |
|---|---|
| Crude Product | 382 g |
| Distillate | 200 g |

-continued

Product Composition After Filtration

| | |
|---|---|
| Calcium | 8.4 % w/w |
| Sulphur | 2.3 % w/w |
| $CO_2$ | 4.4 % w/w |
| TBN | 239 |
| $V_{100}$ | 41 cSt |

The filtration rate in step (h) was slow.

This is not an example according to the present invention and is included for the purpose of demonstrating that the presence of a component (C) is essential to the performance of the process of the invention.

EXAMPLE 9

| | |
|---|---|
| Charge: | As for Example 3. |

Method

As far Example 3 except that the ethylene glycol addition in step (d) was reduced from 32 g to 16 g.

Product Weights

| | |
|---|---|
| Crude Product | 399 g |
| Distillate | 225 g |

Product Composition After Filtration

| | |
|---|---|
| Calcium | 13.7 % w/w |
| Sulphur | 2.0 % w/w |
| $CO_2$ | 13.5 % w/w |
| TBN | 395 |
| $V_{100}$ | 182 cSt |
| Stearic acid | 15.8 % w/w |

The filtration rate in step (h) was slow.

This Example demonstrates that the addition of ethylene glycol can be reduced by 50% as compared with Example 3.

EXAMPLE 10

| | | |
|---|---|---|
| Charge: | Sulphurised calcium alkyl phenate | 230 g |
| | Lubricating oil (100 SN) | 26 g |
| | Ammonium chloride | 4 g |
| | Acetic acid | 2 g |

Method

As for Example 3 except that in step (b) instead of 2-ethyl hexanol (190 g) there was added methyl diglycol (130 g) and in step (d) the addition of ethylene glycol was omitted.

Product Weights

| | |
|---|---|
| Crude Product | 390 g |
| Distillate | 166 g |

Product Composition After Filtration

| | |
|---|---|
| Calcium | 14.1 % w/w |
| Sulphur | 2.0 % w/w |
| $CO_2$ | 14.2 % w/w |
| TBN | 398 |
| $V_{100}$ | 210 cSt |
| $V_{40}$ | 3821 cSt |
| VI | 176 |
| Stearic acid | 16.2 % w/w |

The filtration rate in step (h) was rapid.

This Example demonstrates that methyl diglycol is effective as component (C).

EXAMPLE 11

Charge: As for Example 3.

Method

As for Example 3 except that in step (d) the pressure was 270 mm Hg.

Product Weight

| | |
|---|---|
| Crude Product | 402 g |
| Distillate | 238 g |

Product Composition After Filtration

| | |
|---|---|
| Calcium | 14.0 % w/w |
| Sulphur | 1.9 % w/w |
| $CO_2$ | 14.4 % w/w |
| TBN | 392 |
| $V_{100}$ | 288 cSt |
| Stearic acid | 15.7 % w/w |

EXAMPLE 12

Charge: As for Example 3.

Method

As for Example 3 except that instead of 190 g 2-ethyl hexanol there was used 40 g.

Product Weights

| | |
|---|---|
| Crude Product | 399 g |
| Distillate | 90 g |

Product Composition After Filtration

| | |
|---|---|
| Calcium | 13.9 % w/w |
| Sulphur | 1.9 % w/w |
| $CO_2$ | 12.1 % w/w |
| TBN | 408 |
| $V_{100}$ | 387 cSt |
| $V_{40}$ | 7980 cSt |
| VI | 193 |
| Stearic acid | 15.8 % w/w |

EXAMPLE 13

| | | |
|---|---|---|
| Charge: | Sulphurised calcium alkyl phenate | 230 g |
| | Stearic acid | 63 g |
| | Calcium chloride | 4 g |
| | $C_{18}$ linear alpha-olefin | 26 g |
| | 2-ethyl hexanol | 90 g |

Method (a) The mixture was heated to 145–165° C./700 mm Hg whilst adding ethylene glycol (32 g),
(b) The mixture was held for 30 minutes at 165° C./700 mm Hg,
(c) $CO_2$ (38 g) was added at 165° C./1 bar,
(d) The mixture was cooled to 120° C. and 2-ethyl hexanol (100 g) added,
(e) Lime (66 g) was added,
(f) The mixture was held at 165° C./700 mm Hg for 5 minutes,
(g) Carbon dioxide (66 g) was added,
(h) The solvent was recovered by stripping at 200° C./10 mm Hg,
(i) The product was filtered.

Product Weights

| | |
|---|---|
| Crude Product | 385 g |
| Distillate | 256 g |

Product Composition After Filtration

| | |
|---|---|
| Calcium | 14.8 % w/w |
| Sulphur | 1.9 % w/w |

-continued

| | |
|---|---|
| $CO_2$ | 13.4 % w/w |
| TBN | 424 |
| $V_{100}$ | 583 cSt |
| $V_{40}$ | 13,080 cSt |
| VI | 209 |
| Stearic acid | 16.4 % w/w |

The filtration rate in step (i) was rapid.

This Example demonstrates that a lubricating oil can be replaced by a long carbon chain alpha-olefin (in this case $C_{18}$).

EXAMPLE 14

| | | |
|---|---|---|
| Charge: | Sulphurised calcium alkyl phenate (250 TBN) derived from a mixture of $C_{12}/C_{22}/C_{24}$ alkyl phenols | 233.5 g |
| | Lubricating oil (SN 100) | 26 g |
| | Calcium chloride | 3 g |

Method (a) The mixture was heated to 100° C., stearic acid (63 g) was added and the mixture was stirred for 15 minutes,
(b) 2-Ethyl hexanol (194 g) was added at 100–110° C.,
(c) Lime (66 g) was added at 110° C./2" Hg vacuum,
(d) The mixture was heated to 145° C./10" Hg and ethylene glycol (32 g) added over 20 minutes,
(e) The mixture was held for 5 minutes at 145° C./10" Hg,
(f) Carbon dioxide (66 g) was added,
(g) The product was stripped at 200° C./30" Hg,
(h) The product was filtered.

Product Weights

| | |
|---|---|
| Crude Product | 385 g |
| Distillate | 250 g |

Product Composition After Filtration

| | |
|---|---|
| Calcium | 14.0 % w/w |
| Sulphur | 1.84 % w/w |
| $CO_2$ | 12.9 % w/w |
| TBN | 401 |
| $V_{100}$ | 81 cSt |
| $V_{40}$ | 8385 cSt |
| VI | 186 |
| Stearic acid | 16.4 % w/w |

This Example demonstrates that sulphurised calcium alkyl phenates derived from a mixture of $C_{12}/C_{22}/C_{24}$ alkyl phenols can be upgraded.

EXAMPLE 15

Charge:

| | |
|---|---|
| Sulphurised calcium alkyl phenate | 181 g |
| Lubricating oil (SN 100) | 50 g |
| Calcium chloride | 4 g |
| Rape Top Fatty Acid | 62 g |
| 2-Ethyl hexanol | 190 g |

Method (a) The mixture was heated to 120° C.,
(b) Lime (43 g) was added at 120° C./2" Hg vacuum,
(c) Ethylene glycol (32 g) was added at 145–165° C./2" Hg,
(d) The mixture was held at 165° C./2" Hg for 1 hour,
(e) Carbon dioxide (44 g) was added, -continued (f) The mixture was cooled to 130° C. and lime (29 g) was added at 130° C./2" Hg,
(g) The mixture was held at 165° C./2" Hg for 1 hour,
(h) Lime (22 g) was added at 165° C.,
(i) The product was stripped at 200° C./30" Hg,
(j) The product was filtered.

Product Weights

| | |
|---|---|
| Crude Product | 382 g |
| Distillate | 230 g |

Product Composition After Filtration

| | |
|---|---|
| Calcium | 14.0% w/w |
| Sulphur | 1.8% w/w |
| $CO_2$ | 12.3% w/w |
| TBN | 374 |
| $V_{100}$ | 176 cSt |
| $V_{40}$ | 2826 cSt |
| VI | 172 |
| Carboxylic acid content | 16.2% w/w |

This Example demonstrates that Rape Top Fatty Acid can be used in the process of the invention.

EXAMPLE 16

Charge:

| | |
|---|---|
| Sulphurised calcium alkyl phenate | 230 g |
| Lubricating oil (SN 100) | 26 g |
| Calcium chloride | 3 g |

Method

As for Example 2 except that in step (a) instead of stearic acid (63 g) there was used Tall Oil Fatty Acid (63 g).

Product Weights

| | |
|---|---|
| Crude Product | 380 g |
| Distillate | 223 g |

Product Composition After Filtration

| | |
|---|---|
| Calcium | 14.0% w/w |
| Sulphur | 2.09% w/w |
| $CO_2$ | 9.7% w/w |
| TBN | 380 |
| $V_{100}$ | 263 cSt |
| Carboxylic acid content | 16.6% w/w based on the weight of product. |

This Example demonstrates that Tall Oil Fatty Acid can be used in the process of the invention.

EXAMPLE 17

Charge:

As for Example 16.

Method

As for Example 16 except that instead of Tall Oil Fatty Acid (63 g) there was used a mixture of 52 g polyisobutene succinic anhydride (PIBSA) in SN 100 lubricating oil (TBN = 60 mg KOH/g) and stearic acid (47 g).

Product Weights

| | |
|---|---|
| Crude Product | 390 g |
| Distillate | 219 g |

-continued

Product Composition After Filtration

| | |
|---|---|
| Calcium | 13.1% w/w |
| Sulphur | 1.8% w/w |
| $CO_2$ | 12.5% w/w |
| TBN | 360 |
| $V_{100}$ | 416 cSt |
| $V_{40}$ | 12,690 cSt |
| VI | 164 |
| Carboxylic acid content | 12.1% w/w) based on the |
| Anhydride content | 7.2% w/w) weight of product |

This Example demonstrates that the carboxylic acid can be replaced in part by PIBSA in the process of the invention.

EXAMPLE 18

Charge:

As for Example 16.

Method

As for Example 16 except that instead of Tall Oil Fatty Acid (63 g) there was used behenic acid (63 g).

Product Weights

| | |
|---|---|
| Crude Product | 402 g |
| Distillate | 247 g |

Product Composition After Filtration

| | |
|---|---|
| Calcium | 12.4% w/w |
| Sulphur | 1.9% w/w |
| $CO_2$ | 11.4% w/w |
| TBN | 354 |
| $V_{100}$ | 141 cSt |
| Behenic acid | 15.7% w/w |

This Example demonstrates that behenic acid can be used as the carboxylic acid in the process of the invention.

EXAMPLE 19

Charge:

As for Example 15 except that instead of Rape Top Fatty Acid (62 g) there was used palmitic acid (56.2 g)

Method

As for Example 15 except that steps (f), (g) and (h) were omitted.

Product Weights

| | |
|---|---|
| Crude Product | 312 g |
| Distillate | 222 g |

Product Composition After Filtration

| | |
|---|---|
| Calcium | 11.7% w/w |
| Sulphur | 1.9% w/w |
| $CO_2$ | 8.2% w/w |
| TBN | 332 |
| $V_{100}$ | 70 cSt |
| $V_{40}$ | 831 cSt |
| VI | 156 |
| Palmitic acid | 18.0% w/w |

This Example demonstrates that palmitic acid can be used in the process of the invention.

EXAMPLE 20

Charge:

As for Example 15.

Method

As far Example 15 except that steps (f), (g) and (h) were omitted.

Product Weights

| | |
|---|---|
| Crude Product | 334 g |
| Distillate | 234 g |

Product Composition After Filtration

| | |
|---|---|
| Calcium | 11.8% w/w |
| Sulphur | 1.8% w/w |
| $CO_2$ | 10.9% w/w |
| TBN | 321 |
| $V_{100}$ | 168 cSt |
| $V_{40}$ | 1009 cSt |
| VI | 286 |
| Carboxylic acid content | 18.6% w/w based on the weight of product. |

Comparison Test 2

Charge:

| | |
|---|---|
| Sulphurised calcium alkyl phenate | 230 g |
| Lubricating oil | 26 g |
| Calcium chloride | 3 g |

Method (a) The mixture was heated to 100° C. and 2-ethyl hexanol (190 g) was added,
(b) Acetic acid (14 g) was added,
(c) The mixture became thick and heterogeneous and assumed a green colouration. Stirring was ineffective. The reaction was discontinued.
This Test is not an example according to the present invention and is included only for the purpose of demonstrating that lower carboxylic acids, in this case acetic acid, can not be used in the process of the invention.

EXAMPLE 21

Charge:

As for Example 16 except that instead of the commercially available sulphurised calcium alkyl phenate there was used an uncarbonated commercially available sulphurised calcium $C_{12}$-alkyl phenate (145 TBN).

Method

As for Example 16 except that in step (c) the amount of lime was increased from 66 g to 83 g and in step (f) the amount of carbon dioxide was increased from 66 g to 83 g.

Product Weights

| | |
|---|---|
| Crude Product | 421 g |
| Distillate | 246 g |

Product Composition After Filtration

| | |
|---|---|
| Calcium | 13.7% w/w |
| Sulphur | 1.9% w/w |
| $CO_2$ | 10.3% w/w |
| TBN | 383 |
| $V_{100}$ | 137 cSt |

-continued

| | |
|---|---|
| $V_{40}$ | 2119 cSt |
| VI | 163 |
| Carboxylic acid | 15.0% w/w |

This Example demonstrates that an uncarbonated sulphurised calcium alkyl phenate of low initial TBN can be used in the process of the invention.

EXAMPLE 22

Charge:

| | |
|---|---|
| A carbonated sulphurised calcium alkyl phenate (150 TBN) | 253 g |
| Stearic acid | 40 g |
| 2-Ethyl hexanol | 90 g |
| Calcium chloride | 4 g |

Method (a) The mixture was heated from 145 to 165° C./700 mm Hg whilst adding ethylene glycol (32 g),
(b) The mixture was held at 165° C./700 mm Hg for 30 minutes,
(c) Carbon dioxide (38 g) was added at 165° C./1 bar,
(d) The mixture was cooled to 120° C. and there was added 2-ethyl hexanol (100 g) and lime (76 g),
(e) The mixture was held for 60 minutes at 165° C./700 mm Hg,
(f) Carbon dioxide (82 g) was added at 165° C./1 bar,
(i) Solvent was recovered at 200° C./10 mm Hg, and
(h) The product was filtered.

Product Weights

| | |
|---|---|
| Product Weight | 390 g |

Product Composition After Filtration

| | |
|---|---|
| Calcium | 14.4% w/w |
| Sulphur | 2.3% w/w |
| $CO_2$ | 11.6% w/w |
| TBN | 402 |
| $V_{100}$ | 674 cSt |
| Stearic acid | 10.3% w/w |

This Example demonstrates that a low (150) TBN sulphurised calcium alkyl phenate can be upgraded to a high TBN product.

EXAMPLE 23

Charge:

As for Example 14 except that instead of the sulphurised calcium alkyl phenate derived from a mixture of alkyl phenols there was used the commercially available sulphurised calcium alkyl phenate derived from a $C_{12}$-alkyl phenol (250 TBN).

Method

As for Example 14 except that in step (b) instead of 2-ethyl hexanol (194 g) there was used iso-heptanol (190 g) and in step (d) the ethylene glycol was added quickly (within 1 minute).

Product Weights

| | |
|---|---|
| Crude Product | 402 g |
| Distillate | 239 g |

Product Composition After Filtration

| | |
|---|---|
| Calcium | 13.9% w/w |
| Sulphur | 1.9% w/w |
| $CO_2$ | 12.0% w/w |

-continued

| | |
|---|---|
| TBN | 391 |
| $V_{100}$ | 313 cSt |
| $V_{40}$ | 6700 cSt |
| VI | 177 |
| Stearic acid | 15.7% w/w |

The filtration rate was rapid.

This Example demonstrates that iso-heptanol may be used as solvent in the process of the invention.

What is claimed is:

1. An additive concentrate suitable for incorporation into a finished lubricating oil composition, the additive concentrate comprising:

(a) a lubricating oil, (b) a lubricating oil soluble sulphurised alkaline earth metal hydrocarbyl phenate modified by incorporation in the presence of an inorganic halide catalyst of from 12 to 35% by weight based on the weight of the concentrate of at least one carboxylic acid having the formula:

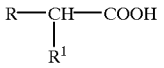

(I)

wherein R is a $C_{10}$ to $C_{24}$ straight chain alkyl or alkenyl group and $R^1$ is hydrogen, said concentrate having a TBN greater than 350 and a viscosity at 100° C. of less than 1,000 cSt.

2. An additive concentrate according to claim 1, wherein the lubricating oil comprises from 10 to 90% by weight of the composition.

3. An additive concentrate according to claim 1, wherein the alkaline earth metal of the lubricating oil soluble sulphurized alkaline earth metal hydrocarbyl phenate is calcium, magnesium or barium.

4. An additive concentrate according to claim 3, wherein the alkaline earth metal is calcium.

5. An additive concentrate according to claim 1, wherein the hydrocarbyl phenate moiety of the oil soluble sulphurized alkaline earth metal hydrocarbyl phenate is derived from at least one alkyl phenol, the alkyl group or groups of the alkyl phenol or phenols containing from 9 to 28 carbon atoms.

6. An additive concentrate according to claim 5, wherein the hydrocarbyl phenol moiety is derived from a $C_{12}$-alkyl phenol obtained by alkylating phenol with propylene tetramer.

7. An additive concentrate according to claim 1, wherein there is incorporated stearic acid.

8. An additive concentrate according to claim 1, wherein there is incorporated carboxylic acid in an amount from 12 to 20% by weight based on the weight of the concentrate.

9. An additive concentrate according to claim 1, wherein carboxylic acid is incorporated in an amount of about 16% by weight based on the weight of the concentrate.

10. An additive concentrate according to claim 1, wherein the TBN of the composition is greater than 400.

11. An additive concentrate according to claim 1, wherein the viscosity at 100° C. is less than 750 cSt.

12. An additive concentrate according to claim 1, wherein the viscosity at 100° C. is less than 500 cSt.

13. A finished lubricating oil composition which composition comprises a lubricating oil and sufficient of an additive concentrate as claimed in claim 1 to provide a TBN in the range from 0.5 to 120.

14. A finished lubricating oil composition according to claim 13, wherein the lubricating oil is a marine lubricating oil and sufficient of the additive concentrate is present to provide a TBN in the range from 9 to 100.

15. A finished lubricating oil composition according to claim 13, wherein the lubricating oil is an automobile engine lubricating oil and sufficient of the additive concentrate is present to provide a TBN in the range from 4 to 20.

16. An additive concentrate according to claim 1, wherein there is incorporated at least one carboxylic acid having the formula (I) wherein R is an unbranched alkyl or alkenyl group.

17. An additive concentrate according to claim 16, wherein in the carboxylic acid of formula (I) R is a $C_{10}$ to $C_{24}$ straight chain alkyl group and $R^1$ is hydrogen.

18. An additive concentrate suitable for incorporation into a finished lubricating oil which concentrate is obtainable by reacting at elevated temperature in the presence of an inorganic halide catalyst (A) a sulphurized alkaline earth metal hydrocarbyl phenate having TBN less than that of the final additive concentrate, (B) an alkaline earth metal base added in either a single addition or in a plurality of additions at intermediate points during the reaction, (C) either a polyhydric alcohol having from 2 to 4 carbon atoms, a di- or tri- $C_2$ to $C_4$-glycol, an alkylene glycol alkyl ether or a polyalkylene glycol alkyl ether, (D) a lubricating oil, (E) carbon dioxide added subsequent to the, or each, addition of component (B), and (F) sufficient to provide from 12 to 35% by weight based on the weight of the concentrate of a carboxylic acid having the formula (I):

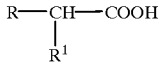

wherein R is a straight chain $C_{10}$ to $C_{24}$ alkyl or alkenyl group and $R^1$ is hydrogen, the weight ratio of components (A) to (F) being such as to produce a concentrate having a TBN greater than 350 and a viscosity at 100° C. of less than 1000 cSt.

19. A process for the production of an additive concentrate, which process comprises reacting at elevated temperature in the presence of a catalyst (A) a sulfurized alkaline earth metal hydrocarbyl phenate having a TBN less than that of the final additive concentrate, (B) an alkaline earth metal base added in either a single addition or in a plurality of additions at intermediate points during the reaction, (C) either a polyhydric alcohol having from 2 to 4 carbon atoms, a di- or tri- $C_2$ to $C_4$ glycol, an alkylene glycol ether or a polyalkylene glycol alkyl ether, (D) a lubricating oil, (E) carbon dioxide added subsequent to the, or each, addition of component (B), and (F) sufficient to provide from 12 to 35% by weight based on the weight of the concentrate of either (i) a carboxylic acid having the formula (I)

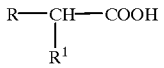

wherein R is a $C_{10}$ to $C_{24}$ alkyl or alkenyl group and $R^1$ is either hydrogen, a $C_1$ to $C_4$ alkyl group or a —$CH_2$—COOH group, or an acid anhydride, acid chloride or ester thereof or (ii) a di- or polycarboxylic acid containing from 36 to 100 carbon atoms or an acid anhydride, acid chloride or ester thereof, the weight ratios of components (A) to (F) being such as to produce a concentrate having a TBN greater than 300 and a viscosity at 100° C. of less than 1000 cSt.

20. A process according to claim 19, wherein component (B) is lime.

21. A process according to claim 19, wherein the weight ratio of component (B) to component (A) is in the range from 0.2 to 5.

22. A process according to claim 19, wherein component (C) is ethylene glycol.

23. A process according to claim 19, wherein component (C) is methyl digol.

24. A process according to claim 19, wherein the carbon dioxide component E is added subsequent to a single addition of component (B) at the conclusion of the reaction between components (A) to (D) and (F).

25. A process according to claim 19, wherein a diluent is present.

26. A process according to claim 19, wherein sulphur additional to that already present by way of component (A) is added to the reaction mixture.

27. A process according to claim 19, wherein the catalyst is selected from the group consisting of an inorganic halide and calcium acetate.

28. A process according to claim 25, wherein the catalyst is an inorganic halide.

29. A process according to claim 28, wherein the catalyst is calcium chloride.

* * * * *